US008516623B2

(12) United States Patent
Yeung

(10) Patent No.: US 8,516,623 B2
(45) Date of Patent: Aug. 27, 2013

(54) TILTING-BOWL TOILET

(76) Inventor: Shu-Ki Yeung, Saint Laurent (CA)

( * ) Notice: Subject to any disclaimer, the term of this patent is extended or adjusted under 35 U.S.C. 154(b) by 366 days.

(21) Appl. No.: 12/325,029

(22) Filed: Nov. 28, 2008

(65) Prior Publication Data

US 2009/0188032 A1 Jul. 30, 2009

(30) Foreign Application Priority Data

Jan. 28, 2008 (CA) ..... 2616699

(51) Int. Cl.
*E03D 11/02* (2006.01)

(52) U.S. Cl.
USPC ..... 4/441; 4/420; 4/434; 4/438; 4/440; 4/442; 222/463; 222/500

(58) Field of Classification Search
USPC ..... 4/420, 434, 441, 442, 438, 440; 222/500, 222/463
See application file for complete search history.

(56) References Cited

U.S. PATENT DOCUMENTS

| | | | | |
|---|---|---|---|---|
| 3,448,689 | A * | 6/1969 | Caldwell | 417/14 |
| 4,142,261 | A * | 3/1979 | Johansen | 4/442 |
| 4,155,129 | A * | 5/1979 | Russell | 4/429 |
| 5,802,627 | A * | 9/1998 | Yeung | 4/313 |
| 6,070,276 | A * | 6/2000 | Yeung | 4/442 |
| 2006/0137085 | A1* | 6/2006 | Xiang et al. | 4/420 |
| 2006/0143815 | A1* | 7/2006 | Peres | 4/442 |
| 2007/0011801 | A1* | 1/2007 | DuBois | 4/442 |

* cited by examiner

*Primary Examiner* — Len Tran
*Assistant Examiner* — Joel Zhou

(57) ABSTRACT

Tilting Bowl Toilet comprises a frame, a toilet basin, and a tilting bowl. The tilting bowl is supported below the toilet basin to receive and hold water/waste delivered from the toilet basin. The tilting bowl tilts to discharge its content to drainage. The tilting bowl at standby is sustained to stay in a horizontal position by a sustaining turning moment about its support axis. When water is added, the turning moment produced by the tilting bowl with its content becomes larger than the sustaining turning moment, and the tilting bowl moves to a tilted position to discharge its content. As the tilting bowl tilts, the sustaining turning moment is simultaneously reduced to accelerate bowl tilting for efficient discharge of waste to sewage.

13 Claims, 3 Drawing Sheets

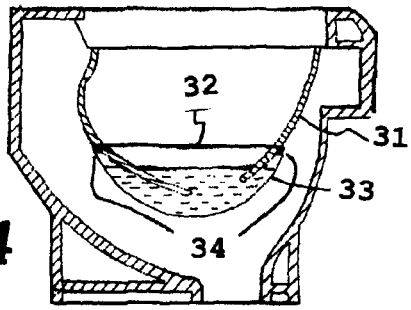
FIG 4
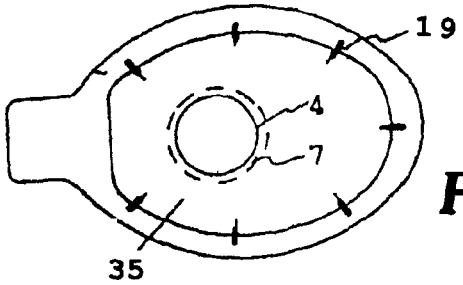
FIG 5
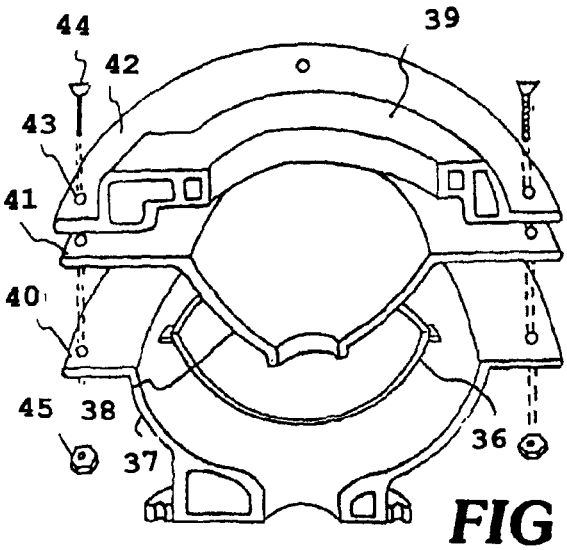
FIG 6
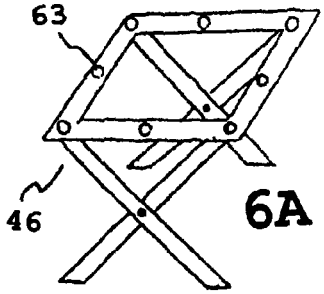
6A
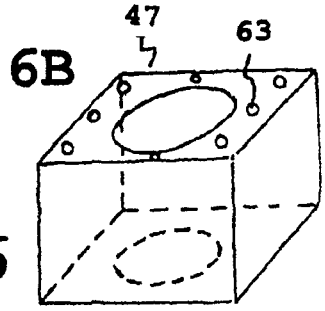
6B

TILTING-BOWL TOILET

BACKGROUND OF THE INVENTION

1. Field of the Invention

The present invention is a new version of tilting-bowl toilet that replaces siphon and zigzag water trap in tank toilets with a tilting bowl. Tilting Bow Toilet eliminates most deficiencies associated with traditional tank toilets, including siphon noise and blocking. With minimum water consumption and yet optimum cleaning, Tilting Bowl Toilet is environmentally friendly in greatly saving water.

2. Brief Description of Prior Arts

Major drawbacks of conventional toilets include necessity for a water tank or water pump to create high-pressured water to force water and waste through a zigzag water trap by siphon action, thus consuming big volume of water and making big siphon noise. Low-flow toilets available are often complained about high noise and insufficient cleaning, often necessitating double-flushing.

Applicant's inventions of Tilting-bowl toilets have been granted U.S. Pat. Nos. 5,802,627 and 6,070,276 and 6,076,200. With improved tilting bowl movement, this new version further improves operation efficiency.

SUMMARY OF THE INVENTION

According to a broad aspect of the present invention, there is provided a toilet comprising:

a frame defining a chamber, a toilet basin associated with said frame to define said chamber into an upper chamber region and a lower chamber region, said toilet basin defining at least one basin discharge opening in communication between said upper chamber region and said lower chamber region, a tilting bowl disposed generally in said lower chamber region, said tilting bowl defining a fluid-receiving volume, said tilting bowl supported for tilting movement relative to said toilet basin between a substantially horizontal first position to receive and hold fluid communicated through said at least one basin discharge opening, and a second position permitting flow of fluid from said toilet basin, through said at least one basin discharge opening, and from said fluid-receiving volume into said lower chamber region, wherein said tilting bowl is sustained to remain in said first position by a sustaining turning moment about the effective support axis at least sufficient to counterbalance the turning moment produced by said tilting bowl with its content, said tilting bowl moves from said first position toward said second position when said sustaining turning moment is smaller than said turning moment produced by said tilting bowl with its content, and said sustaining turning moment comprises at least one movable load adapted to modify said sustaining turning moment strength to accelerate said tilting bowl movement.

In accordance with preferred embodiments of the toilet according to the present invention:

said fluid-receiving volume, in said first position, at least partially overlaps said toilet basin, and retains a volume of fluid sufficient to engage said at least one basin discharge opening in a manner to restrict flow of gas therethrough;

said tilting bowl in said first position constitutes an impervious joint with said toilet basin to restrict gas in said lower chamber region from entering said fluid-receiving volume;

the toilet further comprises means to restrict sewage gas from entering said lower chamber region;

the toilet further comprises means for delivering water through a plurality of outlets disposed and arrayed to direct water in predetermined ejection order against said toilet basin for cleaning action;

the toilet further comprises means for maintaining a predetermined fluid level in said fluid-receiving volume, with said tilting bowl disposed in said first position, said level maintaining means triggering delivery of water when a fluid level below said predetermined fluid level is detected and stopping delivery of water when a fluid level at least equal to said predetermined fluid level is detected;

the toilet further comprises means to discharge excessive fluid when fluid level in said fluid-receiving volume exceeds a prescribed level;

the toilet is adapted for manual triggering, and/or electrical triggering and/or electronic triggering, and/or remote triggering, and/or automatic triggering in response to departure of user;

said tilting bowl is biased to return from said second position toward said first position;

the toilet further comprises retard means to retard said tilting bowl from returning from said second position toward said first position;

said at least one basin discharge opening is disposed generally above a bottom discharge hole and with a vertical projection view at least partially overlapping a vertical projection view of said bottom discharge hole;

said plurality of outlets are arrayed to define an enclosure region disposed generally above said at least one basin discharge opening, said enclosure region casting a vertical projection view at least partially overlapping a vertical projection view of said at least one basin discharge opening and/or at least partially overlapping a vertical projection view of said bottom discharge hole;

the toilet in separate parts comprises separate and/or foldable frame, separate and/or foldable toilet basin, separate and/or foldable tilting bowl, separate and/or foldable water storage container, and/or separate and/or foldable waste container;

The objects, advantages and unique features of present invention will be illustrated and explained by the following non-restrictive description of preferred embodiments thereof, given by way of example only with reference to the accompanying drawings.

BRIEF DESCRIPTION OF THE DRAWING

In the appended drawings:

FIG. 4 is a cross-sectional view of a preferred embodiment of the toilet showing a dry gas seal between tilting bow and toilet basin;

FIG. 5 is a top view of a preferred embodiment of the toilet showing preferred locations of array of jet outlets, basin discharge opening and bottom discharge hole;

FIG. 6 is a cross-sectional perspective view of a preferred self-installable embodiment with separate and/or foldable parts.

DETAILED DESCRIPTION OF THE PREFERRED EMBODIMENTS

Figure 1:
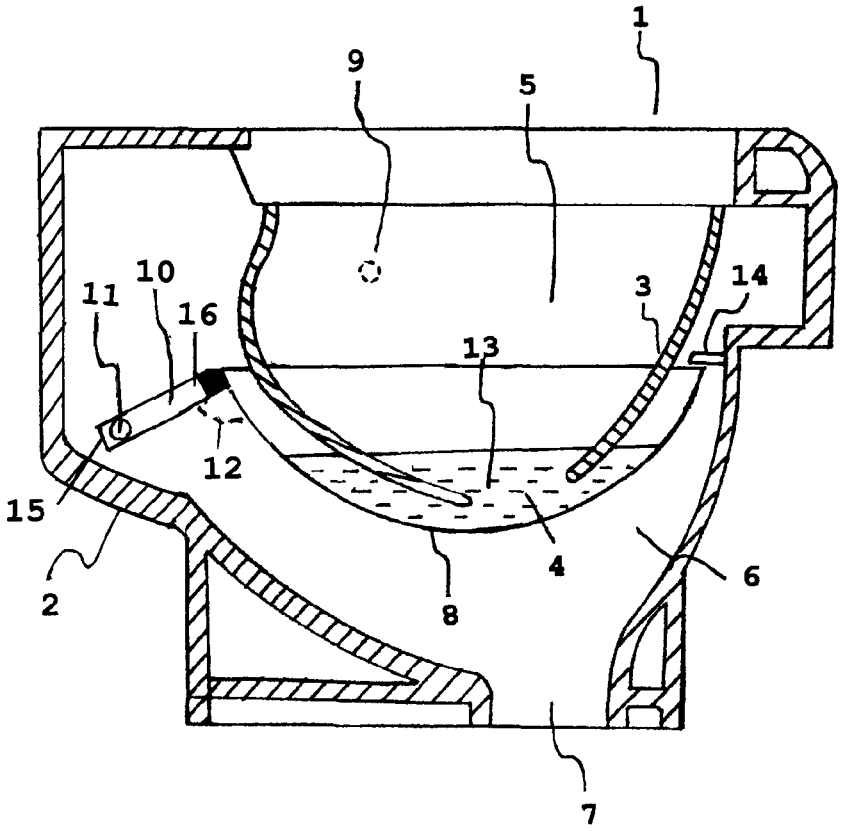
FIG. 1 is a cross-sectional view of a preferred embodiment of the toilet in accordance with the present invention, comprising a tilting bowl.

A preferred embodiment of the toilet in accordance with the present invention is illustrated in FIG. 1, and is generally identified by the reference 1.

Toilet 1 comprises a frame 2 which supports a toilet basin 3 with a basin discharge opening 4 such that basin 3 partitions frame 2 into an upper chamber region 5 and a lower chamber region 6, with discharge opening 4 forming a communication channel between them. Lower chamber region 6 comprises a bottom discharge hole 7 for discharging waste and water to sewage pipes outside the toilet (not shown).

Inside lower chamber region 6, a tilting bowl 8 is sustained to stay just below toilet basin 3 in a generally horizontal position during standby, and capable of tilting about a horizontal axis 9 to move toward a second tilted position to discharge its content. In its standby position, bowl 8 encompasses the lower part of basin 3, and contains a standby volume of water 13 to seal off discharge opening 4 to stop sewage gas from passing through.

Axis 9 is located generally on one side of tilting bowl 8, in this embodiment per FIG. 1, on the left side. Thus weight of bowl 8 and its water content constitutes a turning moment tending to tilt bowl 8 in a clockwise direction. The left end of bowl 8 is connected to a hollow tube 10 with both ends sealed. A metal ball 11, serving as a counter-weight, is placed inside tube 10 and capable of moving from one end to the other end of tube 10. Thus ball 11 constitutes a turning moment tending to tilt bowl 8 in an anticlockwise direction. Tube 10 is fixed to the left end of bowl 8 at a specific angle 12 to the horizontal, with its left end 15 lower than its right end 16, as shown. Thus, at standby, ball 11 stays at left end 15 of tube 10. The weight of ball 11 and length of tube 10 are so chosen that, when bowl 8 is at its standby horizontal position, the anticlockwise sustaining turning moment constituted by ball 11 is generally equal to or greater than the clockwise tilting moment constituted by bowl 8 with its standby water volume 13, so as to maintain bowl 8 in a generally horizontal position. A small block 14 inside toilet frame 2 may also be added to assure bowl 8 not to exceed the generally horizontal position.

Figure 2:
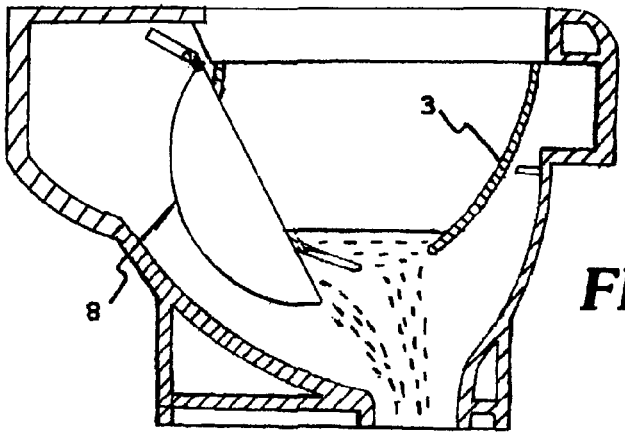
FIG. 2 shows the tilting bowl in tilted position.

When water is added to the toilet and flow into bowl 8, its content weight increases and hence the clockwise turning moment increases. With water gradually added, bowl 8 tilts in a clockwise direction, which in turn moves tube 10 toward a horizontal position, with its left end 15 gradually moving up. When left end 15 moves to higher than right end 16, ball 11 begins to travel toward right end 16. AS ball 11 moves from left to right, the distance between ball 11 and bowl 8 becomes shorter simultaneously, meaning the moment arm for anticlockwise turning is effectively shortened, thus resulting in rapid reduction of anticlockwise turning moment strength. This effectively accelerates bowl 8 tilting toward the second tilted position to rapidly discharge its content into lower chamber 6, to be discharged to sewage through discharge hole 7, as shown in FIG. 2.

Preferably the right end 16 of tube 10 is so located that the anticlockwise sustaining turning moment with ball 11 at right end 16 is greater than the clockwise tilting moment constituted by the empty bowl 8. Thus, when bowl 8 has emptied its content, it will be pushed back towards its standby horizontal position. Alternatively, an individual load (not shown) may be fixed to tube 10 to assure sufficient anticlockwise turning moment to return empty bowl 8 to standby. A volume of water will then be added to bowl 8 to seal opening 4 to assure no sewage gas escape at standby.

Whilst a ball moving inside a tube is illustrated in this embodiment, any alternative design may be used to reduce the sustaining turning moment to accelerate bowl tilting to effect efficient discharge of waste and water content, and are within scope of this invention.

Figure 3:
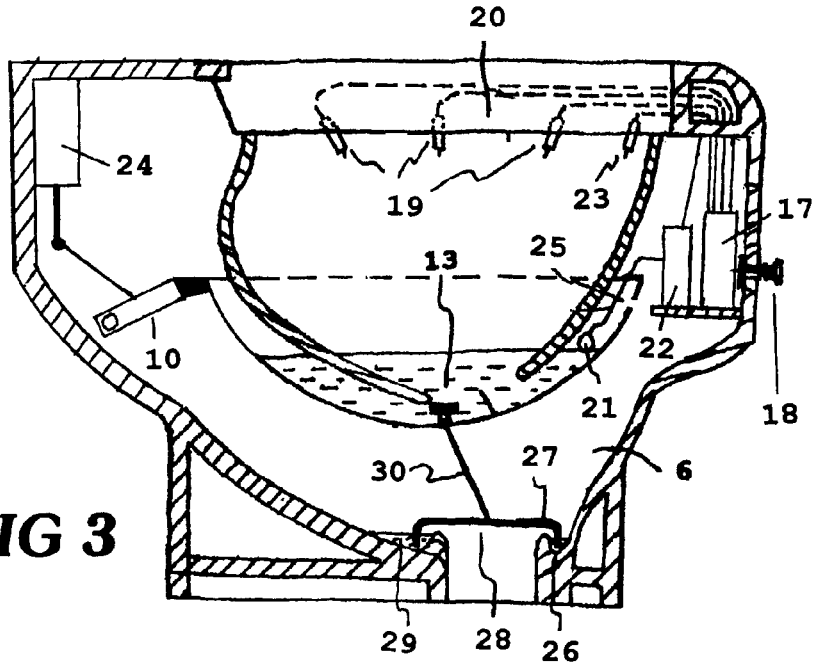
FIG. 3 shows a preferred embodiment with water outlets to supply water for cleaning.

FIG. 3 illustrates another preferred embodiment with automatic water supply. With water valve 17 connected to water mains, a push on trigger switch 18 will start water ejection through water outlets 19 located along inner side of frame rim 20. These water outlets are orientated to achieve optimum cleaning of toilet basin 3. To assure high water pressure cleaning, these outlets preferably should eject water in order of one by one, or pair by pair in sequence, or in any preferred ejection order. Sequential ejection is possible when valve 17 is a sequential valve. A preferred sequential valve is illustrated in Applicant's U.S. Pat. No. 6,070,276. Of course, preferred ejection order includes water ejecting through all outlets simultaneously when water pressure is high.

For those skilled in the art, it is simple to design a valve that can be actuated electrically or electronically. Hence, in addition to, or as alternative to, manual triggering, tilting bowl toilet may also be electrically or electronically triggered. This enables remote triggering to assure a clean toilet prior to entering toilet room. This also enables automatic toilet cleaning upon detection of user departure. Electrical control also enables preset timing for automatic periodic cleaning of public toilets.

To assure sufficient time for basin cleaning, it would be preferable for bowl 8 to slowly return to its horizontal standby position. A slow and gradual return of bowl 8 can be achieved with proper choice of weight of ball 11 and location of tube right end 16 from bowl 8. Alternatively a retarding means 24 connected to tube 10 may be employed, as shown also in FIG. 3. In this way, the time interval for return of bowl 8 is basically determined by retarding means 24, for best cleaning of toilet basin 3. A preferred retarding means is described also in Applicant's granted U.S. Pat. No. 5,802,627.

To assure a gas-sealing water volume 13 at standby, a float 21 can be added, which, when water is below desired level, will trigger to supply water from individual valve 22, through an individual water outlet 23. When water level reaches or is above that of water volume 13, float 21 stops valve 22 operation. On the other hand, whenever water level is too high, excessive water will be discharged through side opening 25 on tilting bowl 8, as also shown in FIG. 3. Whilst this embodiment is incorporated with both means, to raise low water level and to discharge excess water, either means may be used individually in other embodiments as preferred.

As shown in FIG. 3, to restrict sewage gas from entering lower chamber region 6, a liquid seal 28 is formed with a circular groove 26 encircling bottom discharge hole 7 and a circular cover 27 with diameter matching that of circular groove 26. The rim of cover 27 totally dips into water 29 retained in groove 26, thus forming a complete liquid seal to restrict gas from passing through. Cover 27 is connected to bowl 8 by a connecting element 30 with a ring-joint. When bowl 8 tilts, cover 27 is simultaneously lifted up to render bottom discharge hole 7 opened. It is of course possible to use dry seals for seal 28, e.g. rubber seals, without deviating from scope of this invention.

In cases preferred, e.g. for economical embodiments without level control, a dry gas seal can be incorporated between tilting bowl and toilet basin to prevent sewage gas from escaping through basin discharge opening 4, as shown in FIG. 4. In this embodiment, toilet basin 31 is shaped to match curvature of rim 32 of tilting bowl 33 at standby horizontal position. A rubber lining 34 can also be added along rim 32 for impervious joint as shown. Of course, as preferred, a dry gas seal may also be added as an additional safeguard to water volume 13 sealing in all embodiments.

Since there is no zigzag water trap, it is possible for this invention to locate basin discharge opening 4 directly above bottom discharge hole 7 and connect bottom discharge hole 7 directly to sewage pipes which are normally just a short distance from a wall. Thus, when the tilting bowl tilts to discharge, waste water can be directly poured into sewage outlets, resulting in minimum blocking chance, and requires minimum water to carry away waste. In fact, in this invention, region 35 encircled by array of water outlets 19, the basin discharge opening 4, and the bottom discharge hole 7 may be made concentric, as in FIG. 5, or preferably, with vertical views of projection overlapping one another. In cases preferred, basin discharge opening 4 may consist of more than one opening to facilitate easier discharge of waste.

FIG. 6 shows another preferred embodiment comprising separate parts of individual frame, individual tilting bowl, individual basin and toilet rim for user assembly. Frame 37, basin 38 and toilet rim 39 each comprises matching flange 40, 41 and 42 respectively, with matching screw holes 43 suitably located as shown. A user can then assemble the toilet by fixing the separate parts together with screws 44 and nuts 45. The advantage of this embodiment is that separate toilet parts, including fixing accessories, can be packed into a compact package, making the toilet portable.

By making the separate parts foldable, the package volume can be further minimized. Thus, when made with flexible materials like nylon or thick PVC, tilting bowl 36 can be designed to be foldable. Frame 37 can also be replaced by a foldable skeleton support 46, with matching screw holes 63, and a matching PVC envelope 47, also with matching screw holes 63, as shown in FIGS. 6A & 6B. With these foldable parts, all toilet components, including mounting and fixing accessories can be packed inside a hand-carrying case. For use as portable toilets, where tap water may not be available, it is desirable that foldable water storage container be included. Of course, for easy disposal of waste, foldable waste containers may also be included.

Whilst features of present invention are described with reference to preferred embodiments, it is herewith reiterated that these embodiments can be modified at will, within scope of the appended claims, without departing from spirit and nature of subject invention.

What is claimed is:

1. A toilet comprising: a frame defining a chamber, a toilet basin associated with said frame to define said chamber into an upper chamber region and a lower chamber region, said toilet basin defining at least one basin discharge opening in communication between said upper chamber region and said lower chamber region, a tilting bowl disposed generally in said lower chamber region, said tilting bowl defining a fluid-receiving volume, said tilting bowl supported for tilting movement relative to said toilet basin between a substantially horizontal first position to receive and hold fluid communicated through said at least one basin discharge opening, and a second position permitting flow of fluid from said toilet basin, through said at least one basin discharge opening, and from said fluid-receiving volume into said lower chamber region, wherein said tilting bowl is sustained to remain in said first position by a sustaining turning moment located inside said lower chamber region about an effective support axis at least sufficient to counterbalance the turning moment, produced by said tilting bowl with its content, said tilting bowl moves from said first position toward said second position when said sustaining turning moment is smaller than said turning moment produced by said tilting bowl with its content, and said sustaining turning moment comprises at least one movable load, said movable load moves to shorten the distance between said movable load and said tilting bowl to result in reduction of said sustaining turning moment when said tilting bowl tilts to a predetermined position, to accelerate said tilting bowl movement toward fully discharge content received in said fluid-receiving volume.

2. The toilet of claim 1, wherein said fluid-receiving volume, in said first position, at least partially overlaps said toilet basin, and retains a volume of fluid sufficient to engage said at least one basin discharge opening in a manner to restrict flow of gas therethrough.

3. The toilet of claim 1, wherein said tilting bowl in said first position constitutes an impervious joint with said toilet basin to restrict gas in said lower chamber region from entering said fluid-receiving volume.

4. The toilet of claim 1, further comprising means to restrict sewage gas from entering said lower chamber region.

5. The toilet of claim 1, further comprising means for delivering water through a plurality of outlets disposed and arrayed to direct water in predetermined ejection order against said toilet basin for cleaning action.

6. The toilet of claim 1, further comprising fluid level maintaining means for maintaining a predetermined fluid level in said fluid-receiving volume, with said tilting bowl disposed in said first position, said level maintaining means triggering delivery of water when a fluid level below said predetermined fluid level is detected and stopping delivery of water when a fluid level at least equal to said predetermined fluid level is detected.

7. The toilet of claim 1, further comprising means to discharge excessive fluid when fluid level in said fluid-receiving volume exceeds a prescribed level.

8. The toilet of claim 1, wherein said toilet is adapted for manual triggering, and/or electrical triggering and/or electronic triggering, and/or remote triggering, and/or automatic triggering in response to departure of user.

9. The toilet of claim 1, wherein said tilting bowl is biased to return from said second position toward said first position.

10. The toilet of claim 1 further comprising retard means to retard said tilting bowl from returning from said second position toward said first position.

11. The toilet of claim 1, wherein said at least one basin discharge opening is disposed generally above a bottom discharge hole and with a vertical projection view at least partially overlapping a vertical projection view of said bottom discharge hole.

12. The toilet of claim 5, wherein said plurality of outlets are arrayed to define an enclosure region disposed generally above said at least one basin discharge opening, said enclosure region casting a vertical projection view at least partially overlapping a vertical projection view of said at least one basin discharge opening and/or at least partially overlapping a vertical projection view of said bottom discharge hole.

13. The toilet of claim 1, in separate parts comprising separate and/or foldable frame, separate and/or foldable toilet basin, separate and/or foldable tilting bowl, separate and/or foldable water storage container, and/or separate and/or foldable waste container.

* * * * *